US006819350B2

(12) United States Patent
Yokoi

(10) Patent No.: US 6,819,350 B2
(45) Date of Patent: Nov. 16, 2004

(54) IMAGE FORMING APPARATUS AND A CLEANING MECHANISM THEREFOR

(75) Inventor: Katsuyuki Yokoi, Iwakura (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 20 days.

(21) Appl. No.: 10/252,667

(22) Filed: Sep. 24, 2002

(65) Prior Publication Data

US 2003/0058328 A1 Mar. 27, 2003

(30) Foreign Application Priority Data

Sep. 25, 2001 (JP) ..... P2001-292322

(51) Int. Cl.[7] ..... B41J 2/435; G03G 15/30
(52) U.S. Cl. ..... 347/228; 399/149
(58) Field of Search ..... 347/228, 158, 347/213, 140, 165; 399/112, 123, 223, 232, 249, 343, 394, 357, 149, 150, 345, 352

(56) References Cited

U.S. PATENT DOCUMENTS 5,444,515 A * 8/1995 Haneda et al. ..... 399/112
5,752,137 A * 5/1998 Haneda ..... 399/223
6,085,054 A * 7/2000 Kusayanagi ..... 399/249

FOREIGN PATENT DOCUMENTS

JP 62201487 A * 9/1987 ..... G03G/21/00
JP A 2-79890 3/1990
JP A 3-44683 2/1991

* cited by examiner

*Primary Examiner*—Hai Pham
(74) *Attorney, Agent, or Firm*—Oliff & Berridge, PLC

(57) ABSTRACT

Image deterioration due to contact of a cleaning roller and a photosensitive member when an image forming operation stops can be prevented. When the image forming operation stops, a photosensitive belt is stopped in a condition that a stop position of the photosensitive belt corresponds to a photosensitive belt cleaning roller. Even if a stain is caused in the stop position of the photosensitive belt by the contact with the photosensitive belt cleaning roller, an image is formed in an image region of the photosensitive belt, separate from the stop position, in the image forming operation and the image is not deteriorated by the stain.

26 Claims, 5 Drawing Sheets

IMAGE FORMING APPARATUS AND A CLEANING MECHANISM THEREFOR

BACKGROUND OF THE INVENTION

1. Field of Invention

The invention is related to a color laser printer having a photosensitive member and an intermediate transfer member.

2. Description of Related Art

A color laser printer for forming a color image is known. In a color laser printer, an intermediate transfer member bears a color image that is formed by overlapping visible images of each color and the color image on the intermediate transfer member is transferred to a paper. The color laser printer has a plurality of developing devices each of which stores toner of a different color, a photosensitive member bearing a visible image of each color that is developed by toner supplied from each developing device and the intermediate transfer member bearing the visible images of each color in an overlapped condition.

After the visible images formed on a photosensitive belt for each color are transferred to the intermediate transfer member, a small amount of toner remains on the photosensitive member. As shown in Japanese Patent Laid-Open Publication No. 2-79890, a cleaning roller is provided for removing the remaining toner. The cleaning roller is a roller of silicone rubber. The cleaning roller is arranged on a downstream side from a contact position where the photosensitive member contacts the intermediate transfer member and also on an upstream side from the developing device. The cleaning roller contacts a surface of the photosensitive member and captures the remaining toner. Thus, there is no remaining toner to affect the visible image that is next formed and color mixture is prevented.

However, because the cleaning roller always contacts the photosensitive member, the cleaning roller remains in contact with a same position of the photosensitive belt while the photosensitive member is stopped. If the condition is maintained for a long time, the contact portion of the photosensitive member with the cleaning roller is stained. A visible image that will be formed on the contact portion is deteriorated and the color image may be deteriorated.

If the cleaning roller is structured so as to contact and separate from the photosensitive member and the cleaning roller separates from the photosensitive member while the photosensitive member stops, the above-described problem can be prevented. However, when the cleaning roller contacts and separates from the photosensitive member, the surface of the photosensitive member may be blurred by toner. Further, a complicated structure is necessary so that the cleaning roller contacts and separates from the photosensitive member and the cost may be increased.

SUMMARY OF THE INVENTION

An object of the invention is to prevent deterioration of an image due to contact of a cleaning roller and a photosensitive member when an image forming operation stops.

In an image forming apparatus of the invention, a photosensitive member has an image region and a no-image region and a developing device is arranged corresponding to the photosensitive member and supplies developer to the image region of the photosensitive member. The image forming apparatus has a cleaning roller arranged corresponding to the photosensitive member for capturing the developer on a surface of the photosensitive member by contacting the surface of the photosensitive member. The image forming apparatus has a controller for stopping the photosensitive member at a position where the no-image region of the photosensitive member contacts the cleaning roller.

Stop control means stops the photosensitive member in a position so the no-image region of the photosensitive member contacts the cleaning roller. Even if the image forming apparatus is left for a long time in that condition, toner is supplied to the image region of the photosensitive member and toner is not supplied to the no-image region in forming an image. That is, even if the no-image region of the photosensitive member is stained by contact with the cleaning roller, a subsequent image formed is not affected by the stain.

BRIEF DESCRIPTION OF THE DRAWINGS

The invention will be described with reference to the drawings in which.

DETAILED DESCRIPTION OF PREFERRED EMBODIMENTS

Figure 1:
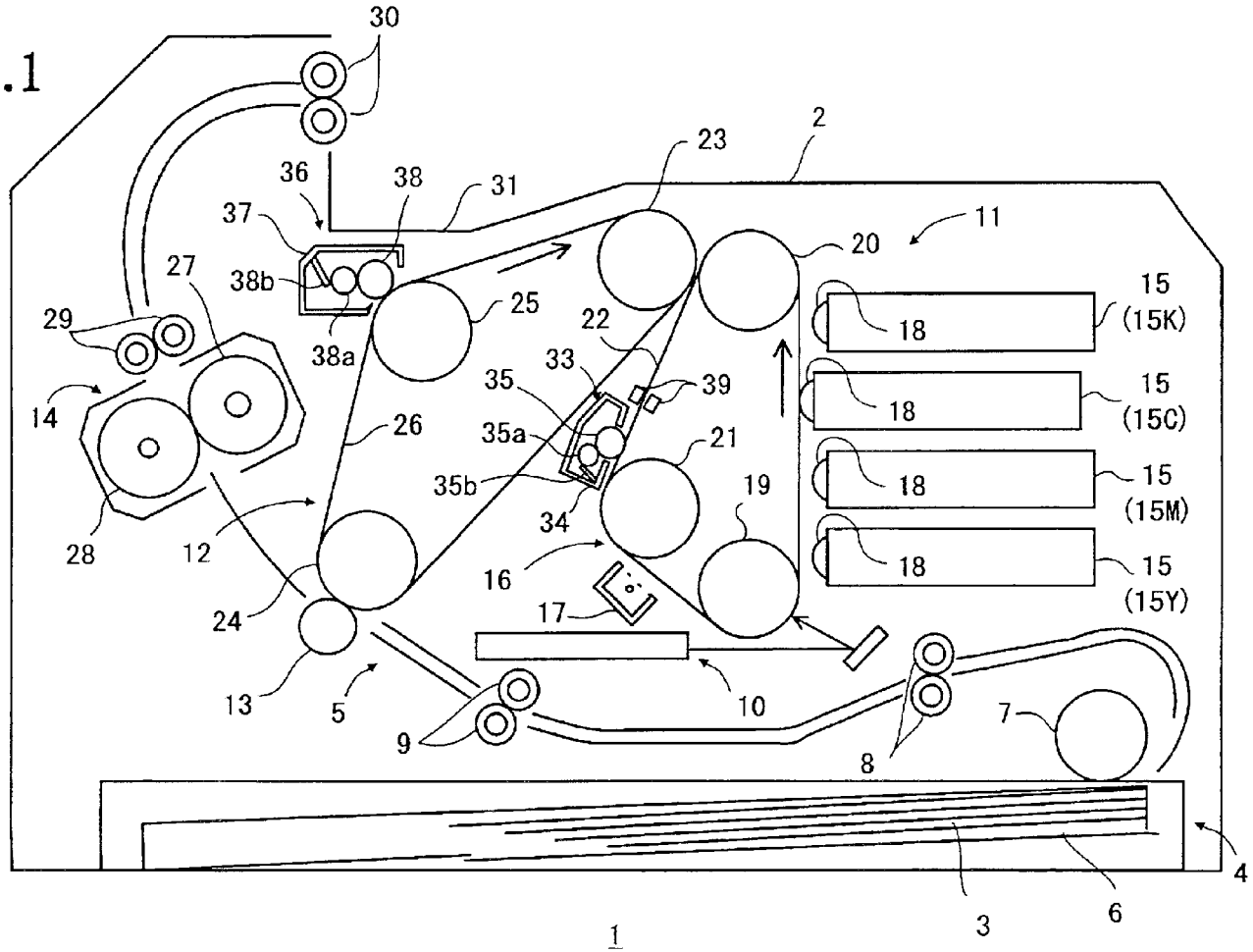
FIG. 1 is a cross-sectional view of a main portion of a color laser printer of one embodiment.

FIG. 1 is a cross-sectional view of a main portion of a color laser printer in which an image forming apparatus of the invention is embodied. The color laser printer 1 has a paper supply portion 4 for supplying a paper 3 and an image forming portion 5 for forming a predetermined image onto a supplied paper 3 in a casing 2.

The paper supply portion 4 has a paper supply tray 6 and a paper supply roller 7 and papers 3 are stacked on the paper supply tray 6 in the paper supply portion 4. A paper 3 positioned at the top in the paper supply tray 6 is picked up one by one by rotation of the paper supply roller 7 and transported to the image forming portion 5 by transporting rollers 8 and resist rollers 9.

The image forming portion 5 has a scanner unit 10, a process portion 11, an intermediate transfer belt mechanism 12, a transfer roller 13 and a fixing portion 14.

The scanner unit 10 is arranged at a center of the casing 2 and has a laser emission portion, a polygon mirror and a plurality of lenses and reflection mirrors (not shown). A laser beam emitted from the laser emission portion, based on predetermined image data, is passed or reflected via the polygon mirror, the reflection mirrors and lenses and irradiated onto a surface of a photosensitive belt 22.

The process portion 11 has a plurality of (four) developing cartridges 15, a photosensitive belt mechanism 16 and a scorotron type charger 17.

The four developing cartridges 15 include a yellow cartridge 15Y storing yellow toner, a magenta cartridge 15M storing magenta toner, a cyan cartridge 15C storing cyan toner and a black cartridge 15K storing black toner. Each of the cartridges 15Y, 15M, 15C, 15K is arranged from the bottom to top in that order at the rear side of the casing 2 having a predetermined distance with respect to each other.

Each of the cartridges 15Y, 15M, 15C, 15K has a developing roller 18, a layer thickness restricting blade, a supply roller and a toner storing portion (not shown). The cartridges 15Y, 15M, 15C, 15K can be moved in a horizontal direction by a cartridge drive mechanism 56 (referring to FIG. 3) and the developing roller 18 contacts and separates from the surface of the photosensitive belt 22.

Developer of yellow, magenta, cyan and black is stored in each of the cartridges 15Y, 15M, 15C, 15K respectively. A positive charged, non-magnetic, one component, polymerized toner is used as the developer. Toner is supplied to the developing roller 18 by the supply roller and restricted to a layer of a predetermined thickness by the layer thickness restricting blade and the surface of the developing roller 18 bears the layer of toner.

The photosensitive belt mechanism 16 is arranged in front of the four cartridges 15 and includes a first photosensitive belt roller 19, a second photosensitive belt roller 20, a third photosensitive belt roller 21 and the photosensitive belt 22. The first photosensitive belt roller 19 is arranged so as to be generally adjacent the yellow cartridge 15Y that is positioned at the bottom. The second photosensitive belt roller 20 is the highest belt roller in the vertical direction and above the first photosensitive belt roller 19 so as to be generally adjacent to the black cartridge 15K that is positioned at the top. The third photosensitive belt roller 21 is arranged in an upper slanted, front direction from the first photosensitive belt roller 19 and a lower slanted, front direction from the second photosensitive belt roller 20. The third photosensitive belt roller 21 operates as a movement supporting member. The photosensitive belt 22 is an endless belt wound around the first photosensitive belt roller 19, the second photosensitive belt roller 20, and the third photosensitive belt roller 21.

As shown in FIG. 1, the first photosensitive belt roller 19, the second photosensitive belt roller 20 and the third photosensitive belt roller 21 are arranged in a triangular shape and the photosensitive belt 22 is wound around the rollers. Each surface of the first photosensitive belt roller 19, the second photosensitive belt roller 20 and the third photosensitive belt roller 21 contacts an inner surface of the photosensitive belt 22.

The photosensitive belt 22 is obtained by forming an organic photosensitive layer on a surface of an endless belt made of PET (polyethylene terephthalate) that has aluminum evaporated thereon. The length of the photosensitive belt 22 is longer than a length of a maximum size paper that can be printed in the color laser printer 1.

The second photosensitive belt roller 20 is connected to a drive shaft of a main motor 54 (referring to FIG. 3) by a gear and driven by the main motor 54. The first photosensitive belt roller 19 and the third photosensitive belt roller 21 are following rollers and driven by driving of the second photosensitive belt roller 20. The photosensitive belt 22 moves around the first photosensitive belt roller 19, the second photosensitive belt roller 20 and the third photosensitive belt roller 21 as shown in FIG. 1.

Figure 2:
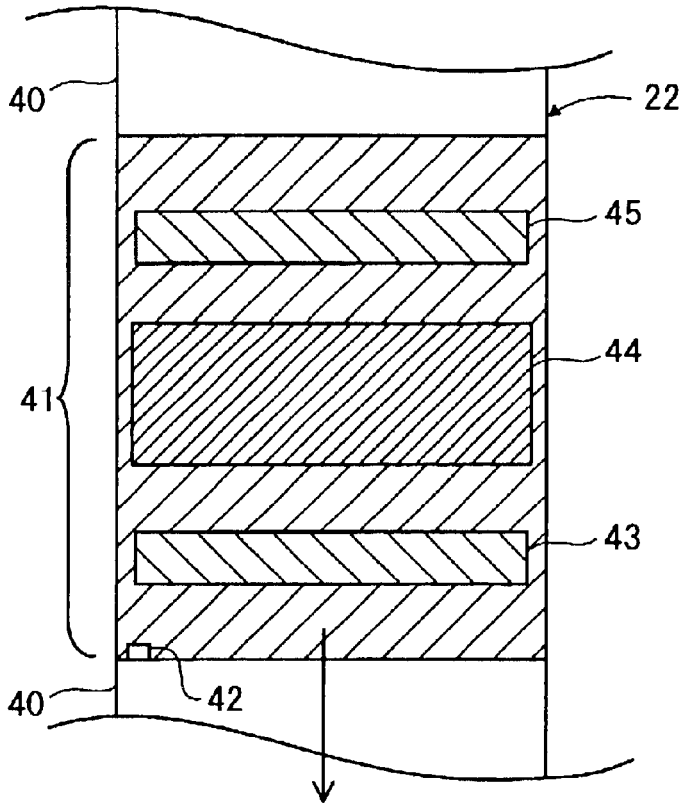
FIG. 2 is a plan view of a main portion of a photosensitive belt in the color laser printer shown in FIG. 1.

As shown in FIG. 2, there is provided an opening portion 42 of almost a rectangular shape on one side in a width direction of the photosensitive belt 22. The opening portion penetrates in a thickness direction of the photosensitive belt 22.

An original point sensor 39 is provided in the photosensitive belt mechanism 16. The original point sensor 39 is comprised of a light emission portion and a light receiving portion that face each other with the photosensitive belt 22 passing therebetween. The original point sensor 39 is positioned between the second photosensitive belt roller 20 and the third photosensitive belt roller 21. When light from the light emission portion passes through the opening portion 42 and is detected by the light receiving portion, the light receiving portion generates a detection signal.

The photosensitive belt 22 is divided into an image region 40 where a static latent image is formed and a no-image region 41 where a static latent image is not formed based on the detection of the opening portion 42 by the original point sensor 39. A separating position 43 of the developing roller 18 and a contact position 45 of the developing roller 18 are set in the no-image region 41. A stop position 44 where the photosensitive belt cleaning roller 35 stops is set between the separating position 43 and the contact position 45.

The contact position 45 is a position where the developing roller 18 contacts the photosensitive belt 22 and the separating position 43 is a position where the contact of the developing roller 18 and the photosensitive belt 22 is released.

The separating position 43 is set on an upstream side from the opening portion 42 with respect to the movement direction of the photosensitive belt 22. The stop position 44 is set on an upstream side from the separating position 43. The contact position 45 is set on an upstream side from the stop position 44.

The intermediate transfer belt mechanism 12 is arranged in front of the photosensitive belt mechanism 16 and includes a first intermediate transfer belt roller 23, a second intermediate transfer belt roller 24, a third intermediate transfer belt roller 25 and an intermediate transfer belt 26.

The first intermediate transfer belt roller 23 is arranged adjacent to the second photosensitive belt roller 20. The second intermediate transfer belt roller 24 is arranged in a slanted, lower direction from the first intermediate transfer belt roller 23. The intermediate transfer belt 26 is an endless belt wound around the first intermediate transfer belt roller 23, the second intermediate transfer belt roller 24, and the third intermediate transfer belt roller 25. The intermediate transfer belt 26 is made from polycarbonate or polyimide. Conductivity is applied to the intermediate transfer belt 26 by dispersing conductive particles, such as carbon, therein.

The photosensitive belt 22 and the intermediate transfer belt 26 are held between the first intermediate transfer belt roller 23 and the second photosensitive belt roller 20. The surface of the photosensitive belt 22 and the surface of the intermediate transfer belt 26 are in contact.

The first intermediate transfer belt roller 23, the second intermediate transfer belt roller 24, and the third intermediate transfer belt roller 25 are arranged in a triangular shape and the intermediate transfer belt 26 is wound therearound.

The first intermediate transfer belt roller 23 is connected to a drive shaft of the main motor 54 (referring to FIG. 3) by a gear and driven by the main motor 54. The second intermediate transfer belt roller 24 and the third intermediate transfer belt roller 25 are following rollers and driven by driving of the first intermediate transfer belt roller 23. The intermediate transfer belt 26 moves around the first intermediate transfer belt roller 23, the second intermediate transfer belt roller 24, and the third intermediate transfer belt roller 25 as shown in FIG. 1.

At a position where the photosensitive belt 22 and the intermediate transfer belt 26 are in contact, the photosensitive belt 22 and the intermediate transfer belt 26 move in the same direction.

The transfer roller 13 is arranged to oppose the second intermediate transfer belt roller 24. The intermediate transfer belt 26 passes between the transfer roller 13 and the second intermediate transfer belt roller 24. A paper 3 is transported between the transfer roller 13 and the intermediate transfer belt 26 in contact with the intermediate transfer belt 26. A predetermined transfer bias is applied to the transfer roller 13 when the paper 3 is transported.

The scorotron type charger 17 is arranged at a lower side of the photosensitive belt mechanism 16. The scorotron type charger 17 generates a corona discharge from a wire of tungsten to uniformly positively charge a surface of the photosensitive belt 22. The scorotron type charger 17 is arranged between the third photosensitive belt roller 21 and the first photosensitive belt roller 19 at a predetermined distance from the photosensitive belt 22.

The fixing portion 14 is arranged after, in the direction of paper 3 movement, the intermediate transfer belt mechanism 12. The fixing portion 14 has a heat roller 27, a press roller 28 pressing the heat roller 27 and a pair of transporting rollers 29 arranged at a downstream side of the heat roller 27 and the press roller 28.

The heat roller 27 is obtained by covering an outer periphery of a metal, cylindrical roller with silicone rubber and has a halogen lamp therein. When the paper 3 passes between the heat roller 27 and the press roller 28, toner adhered on the paper 3 is melted and fixed by heat of the heat roller that is heated by the halogen lamp.

The paper 3, on which a color image is fixed, is transported to a pair of discharge rollers 30 by the transporting rollers 29. The paper 3 is transported to the discharge rollers 30 and is discharged onto a discharge tray 31 that is formed above the casing 2.

After the surface of the photosensitive belt 22 is uniformly positively charged, it is exposed by a laser beam irradiated from the scanner unit 10. A static latent image is formed on the image region 40 of the photosensitive belt 22 based on predetermined image data.

When the developing roller 18 of the appropriate developing cartridge 15 contacts the photosensitive belt 22 where the static latent image is formed, toner of a single color stored in the appropriate developing cartridge 15 adheres to the static latent image and a visible image is formed. The visible image of a single color formed on the photosensitive belt 22 is transferred to the intermediate transfer belt 26 at the facing to the intermediate transfer belt 26. A color visible image formed by four kinds of toner can be obtained on the intermediate transfer belt 26 by executing the same operation for the four cartridges 15Y, 15M, 15C, 15K.

The embodiment will be explained in more detail. The yellow cartridge 15Y positioned at the lowest position is moved horizontally in a forward direction by a developing cartridge drive mechanism 56. The developing roller 18 of the yellow cartridge 15Y contacts the image region of the photosensitive belt 22. At this time, the magenta cartridge 15M, the cyan cartridge 15C and the black cartridge 15K are maintained in the base (home) position and the developing roller 18 of each cartridge 15M, 15C, 15K remains separated from the photosensitive belt 22.

When, a yellow visible image is formed in the image region 40 of the photosensitive belt 22 using yellow toner stored in the yellow cartridge 15Y. When the photosensitive belt 22 is moved and the yellow visible image formed on the photosensitive belt 22 faces the intermediate transfer belt 26, the yellow visible image is transferred to the intermediate transfer belt 26. After the visible image is transferred onto the intermediate transfer belt 26, the remaining toner on the photosensitive belt 22 is removed in a method described below.

After another static latent image is formed on the photosensitive belt 22, the yellow cartridge 15Y is moved rearward, to the base position, by the developing cartridge drive mechanism 56. The magenta cartridge 15M, positioned second from the bottom, is moved forward to contact the image region of the photosensitive belt 22. The yellow cartridge 15Y, the cyan cartridge 15C and the black cartridge 15K are maintained in the base position and the developing roller 18 of each cartridge 15Y, 15C, 15K is separated from the photosensitive belt 22.

A magenta visible image is formed in the image region 40 of the photosensitive belt 22 using magenta toner stored in the magenta cartridge 15M. When the photosensitive belt 22 is moved and the magenta visible image formed on the photosensitive belt 22 faces the intermediate transfer belt 26, the magenta visible image is transferred and overlapped with the yellow visible image that has been previously transferred to the intermediate transfer belt 26.

The same operation is executed for the cyan cartridge 15C and the black cartridge 15K. Thus, a color visible image is formed on the intermediate transfer belt 26 by overlapping the four kinds of toner. The color visible image formed on the intermediate transfer belt 26 is transferred at one time onto a paper 3 passing between the intermediate transfer belt 26 and the transfer roller 13.

The color laser printer 1 has a photosensitive belt cleaning device 33 for collecting toner remaining on the surface of the photosensitive belt 22. The photosensitive belt cleaning device 33 is arranged on a side opposite to the developing cartridges 15 with respect to the photosensitive belt mechanism 16 and adjacent the third photosensitive belt roller 21, between the second photosensitive belt roller 20 and the third photosensitive belt roller 21. The photosensitive belt cleaning device 33 has a photosensitive belt cleaning box 34, a photosensitive belt cleaning roller 35, a second photosensitive belt cleaning roller **35*a* and a photosensitive cleaning blade 35*b***.

The photosensitive belt cleaning box 34 is formed in a box shape and has an opening portion on a side facing the photosensitive belt 22. A lower space in the photosensitive belt cleaning box 34 is a discharge toner storing portion that stores removed toner.

The photosensitive belt cleaning roller 35 is formed of an elastic member, such as silicone rubber, and is supported at the opening portion of the photosensitive belt cleaning box 34 so as to be in rotatable contact with the outer surface of the photosensitive belt 22. Because the photosensitive belt cleaning roller 35 is formed of an elastic member, the possibility is low that the surface of the photosensitive belt 22 will be damaged. The photosensitive belt cleaning roller 35 is arranged to rotate in the same direction as the photosensitive belt 22 (counterclockwise in FIG. 1) at the contact position with the photosensitive belt 22. A predetermined cleaning bias is applied to the photosensitive belt cleaning roller 35 by a cleaning bias applying circuit 53 and a predetermined electric field is generated between the photosensitive belt cleaning roller 35 and the photosensitive belt 22.

The second photosensitive belt cleaning roller 35*a* is a metal roller and arranged so as to contact the surface of the photosensitive belt cleaning roller 35. A predetermined bias is applied to the second photosensitive belt cleaning roller 35*a*.

The photosensitive belt cleaning blade 35*b* is a thin plate member arranged so as to contact the entire length of the second photosensitive belt cleaning roller 35*a*. The photosensitive belt cleaning blade 35*b* removes toner adhered on the surface of the second photosensitive belt cleaning roller 35*a*.

Some toner remains on the photosensitive belt 22 after toner of each color is transferred to the intermediate transfer belt 26. The remaining toner is electrically captured by the photosensitive belt cleaning roller 35 when the photosensitive belt 22 faces the photosensitive belt cleaning roller 35 as the photosensitive belt 22 moves. The electrically captured toner is then electrically captured by the second photosensitive belt cleaning roller 35*a* from the photosensitive belt cleaning roller 35. Moreover, the toner is removed by the photosensitive belt cleaning blade 35*b* and stored in the discharge toner storing portion.

Figure 5:
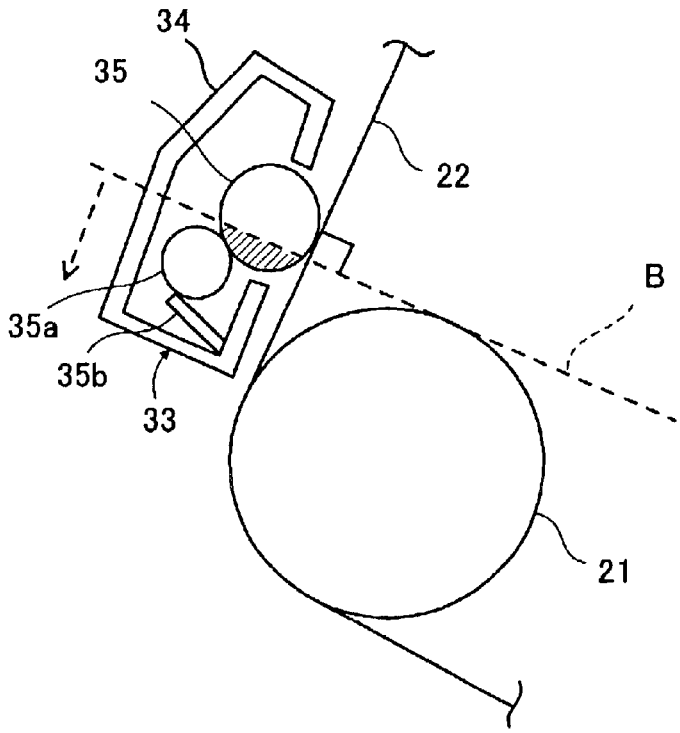
FIG. 5 is an enlarged cross-sectional view of a main portion of the photosensitive belt mechanism of the color laser printer shown in FIG. 1.

As shown in FIG. 5, a tangent line B is provided with respect to the outer peripheral surface of the third photosensitive belt roller 21 so as to intersect vertically with the photosensitive belt 22. The photosensitive belt cleaning roller 35 is arranged so that a portion of the photosensitive belt cleaning roller 35 is positioned on the third photosensitive belt roller 21 side with respect to the tangent line B. Because the radius of curvature (R) of the photosensitive belt cleaning roller 35 is set equal to or greater than 15 mm, permanent deformation of the photosensitive belt 22 due to curvature of the third photosensitive belt roller 21 is prevented. The photosensitive belt cleaning roller 35 is arranged quite close to the third photosensitive belt roller 21.

Because the photosensitive belt cleaning roller 35 and the third photosensitive belt roller 21 are arranged so as to face with each other in a slanted position relative to the photosensitive belt 22, the photosensitive belt 22 does not receive a strong pressing force from the photosensitive belt cleaning roller 35 and the third photosensitive belt roller 21.

Even if the printer 1 is left in an environment of high temperature and high humidity for a long time before shipping or when the printer 1 is not operated for a long time, the photosensitive belt 22 sticking to the photosensitive belt cleaning roller 35 is prevented. Because the photosensitive belt cleaning roller 35 does not receive strong pressing force from the third photosensitive belt roller 21, permanent deformation is prevented.

Because the load due to the pressing force of the photosensitive belt cleaning roller 35 is decreased when the photosensitive belt 22 moves, the photosensitive belt 22 moves smoothly. Also, because the photosensitive belt cleaning roller 35 is arranged close to the third photosensitive belt roller 21, bending of the photosensitive belt 22 is minimized.

Normally, the photosensitive belt cleaning roller 35 does not have a uniform diameter over a whole width in its axial direction and has a margin of error in its diameter. In the above structure, the photosensitive belt cleaning roller 35 can be pressured toward the photosensitive belt 22 with predetermined pressing force and the photosensitive belt 22 and the photosensitive belt cleaning roller 35 are contacted uniformly.

If the photosensitive belt cleaning roller 35 is arranged far from the third photosensitive belt roller 21, bending of the photosensitive belt 22 becomes large and it becomes difficult to contact the photosensitive belt cleaning roller 35 and the photosensitive belt 22 uniformly. To solve such a problem, if the tension of the photosensitive belt 22 is set large, the durability of the photosensitive belt 22 is decreased. In this embodiment, the problem is solved and the photosensitive belt cleaning roller 35 contacts the photosensitive belt 22 uniformly to capture toner efficiently.

In the color laser printer 1 of the embodiment, a color image of high quality can be formed by precise fluidity of polymerized toner. Because the polymerized toner has almost a spherical shape and fluidity is high, the polymerized toner can be easily moved by an electric field and is easy to transfer. On the other hand, if the polymerized toner were to be removed mechanically by a blade, the polymerized toner is hard to remove because of the high fluidity and it is necessary to strongly pressure the polymerized toner.

To remove toner mechanically, the blade must necessarily be pressed strongly toward the photosensitive belt 22. However, the photosensitive belt 22 may be damaged and/or the photosensitive belt 22 may not be driven stably.

However, in the color laser printer 1 of the embodiment, toner is captured by applying a cleaning bias to the photosensitive belt cleaning roller 35. It is not necessary to pressure the photosensitive belt cleaning roller 35 toward the photosensitive belt 22 strongly. Therefore, deformation and damage of the photosensitive belt cleaning roller 35 and the photosensitive belt 22 due to the contact of the photosensitive belt cleaning roller 35 and the photosensitive belt 22 is prevented. Toner remaining on the photosensitive belt 22 after image transfer can be captured effectively.

The length (L) of the photosensitive belt 22, the peripheral length, i.e., circumference, (M) of the photosensitive belt cleaning roller 35 and peripheral velocity ratio ($\alpha$) of the photosensitive belt cleaning roller 35 with respect to the photosensitive belt 22, i.e., the rotation speed of the outer surface of the belt cleaning roller 35 to the photosensitive belt 22 speed, are set so as to satisfy the following formula:

$$L/(\alpha^{*}M) \neq n \quad (n \text{ is an integer}).$$

As structured above, when the photosensitive belt cleaning roller 35 contacts the no-image region 41 of the photosensitive belt 22 and stops, the photosensitive belt cleaning roller 35 does not stop in a condition that the same portion of the photosensitive belt cleaning roller 35 contacts the photosensitive belt 22.

For example, suppose that the length (L) of the photosensitive belt 22 is 400 mm, the peripheral length (M) of the photosensitive belt cleaning roller 35 is 100 mm, and inverse ($\alpha$) of the peripheral velocity ratio is ½ (that is, the peripheral velocity of the photosensitive belt cleaning roller 35 is twice the peripheral velocity of the photosensitive belt 22). In this case, $L/(\alpha^{*}M)=8$ and it does not satisfy the above formula.

In this condition, when the photosensitive belt 22 makes one rotation, the photosensitive belt cleaning roller 35 makes eight rotations. As the photosensitive belt 22 stops so that the photosensitive belt cleaning roller 35 certainly contacts the stop position 44, the photosensitive belt 22 stops in a condition that the same portion of the photosensitive belt cleaning roller 35 contacts the photosensitive belt 22. Because the photosensitive belt cleaning roller 35 is made of an elastic member, the photosensitive belt cleaning roller 35 may be deformed if the photosensitive belt 22 stops in a condition that the same position of the photosensitive belt cleaning roller 35 contacts the photosensitive belt 22 every time.

On the other hand, when the peripheral length (M) of the photosensitive belt cleaning roller 35 is 125 mm and other conditions are same as above, $L/(\alpha^*M)=6.4$ and it satisfies the above formula. In this condition, when the photosensitive belt 22 moves one rotation, the photosensitive belt cleaning roller 35 moves 6.4 rotations. Even if the photosensitive belt 22 stops so that the photosensitive belt cleaning roller 35 certainly contacts the stop position 44, the position on the photosensitive belt cleaning roller 35 that the photosensitive belt 22 contacts is different from the contact position of the photosensitive belt cleaning roller 35 when the photosensitive belt 22 stopped at the previous time. Therefore, the possibility that the photosensitive belt cleaning roller 35 may be deformed is low.

An intermediate transfer belt cleaning device 36 is arranged on a side of the intermediate transfer belt mechanism 12. The intermediate transfer belt cleaning device 36 is arranged so as to oppose the third intermediate transfer belt roller 25. The intermediate transfer belt cleaning device 36 has an intermediate transfer belt cleaning box 37, an intermediate transfer belt cleaning roller 38, a second intermediate transfer belt cleaning roller 38*a* and an intermediate transfer belt cleaning blade 38*b*.

The intermediate transfer belt cleaning box 37 is formed in a box shape and has an opening portion on a side facing the intermediate transfer belt 26. A lower space in the intermediate transfer belt cleaning box 37 is a discharge toner storing portion.

The intermediate transfer belt cleaning roller 38 is an elastic roller, for example, having a surface of silicon rubber, and supported rotatably at the opening portion of the intermediate transfer belt cleaning box 37. The intermediate transfer belt cleaning roller 38 is arranged so as to oppose the third intermediate transfer belt roller 25 with the intermediate transfer belt 26 therebetween.

The intermediate transfer belt cleaning roller 38 is arranged so as to contact and separate from the intermediate transfer belt 26. A predetermined bias is applied to the intermediate transfer belt cleaning roller 38 and an electric field is generated between the intermediate transfer belt cleaning roller 38 and the intermediate transfer belt 26.

The second intermediate transfer belt cleaning roller 38*a* is a metal roller and arranged so as to contact a surface of the intermediate transfer belt cleaning roller 38 and a predetermined bias is applied to the second intermediate transfer belt cleaning roller 38*a*.

The intermediate transfer belt cleaning blade 38*b* is a thin plate member that is arranged so as to contact the entire length of the second intermediate transfer belt cleaning roller 38*a*. The intermediate transfer belt cleaning blade 38*b* removes toner adhered to a surface of the second intermediate transfer belt cleaning roller 38*a*.

After toner is transferred to the paper 3, any toner remaining on the intermediate transfer belt 26 is electrically captured by the second intermediate transfer belt cleaning roller 38*a* through the intermediate transfer belt cleaning roller 38 as the intermediate transfer belt 26 moves.

The captured toner is electrically captured by the second intermediate transfer belt cleaning roller 38*a* when the captured toner on the intermediate transfer belt cleaning roller 38 faces the second intermediate transfer belt cleaning roller 38*a*. Moreover, the toner is removed by the intermediate transfer belt cleaning blade 38*b* and stored in the discharge toner storing portion.

The intermediate transfer belt cleaning roller 38 is separated from the intermediate transfer belt 26, with a predetermined distance therebetween, until toner is transferred from the photosensitive belt 22 to the intermediate transfer belt 26. When the color visible image on the intermediate transfer belt 26 is transferred to the paper 3, the intermediate transfer belt cleaning roller 38 contacts the intermediate transfer belt 26.

Next, control for driving and stopping the photosensitive belt 22 and a control system for controlling a contact/separating operation of the developing cartridge 15Y, 15M, 15C, 15K with respect to the photosensitive belt 22 will be described.

Figure 3:
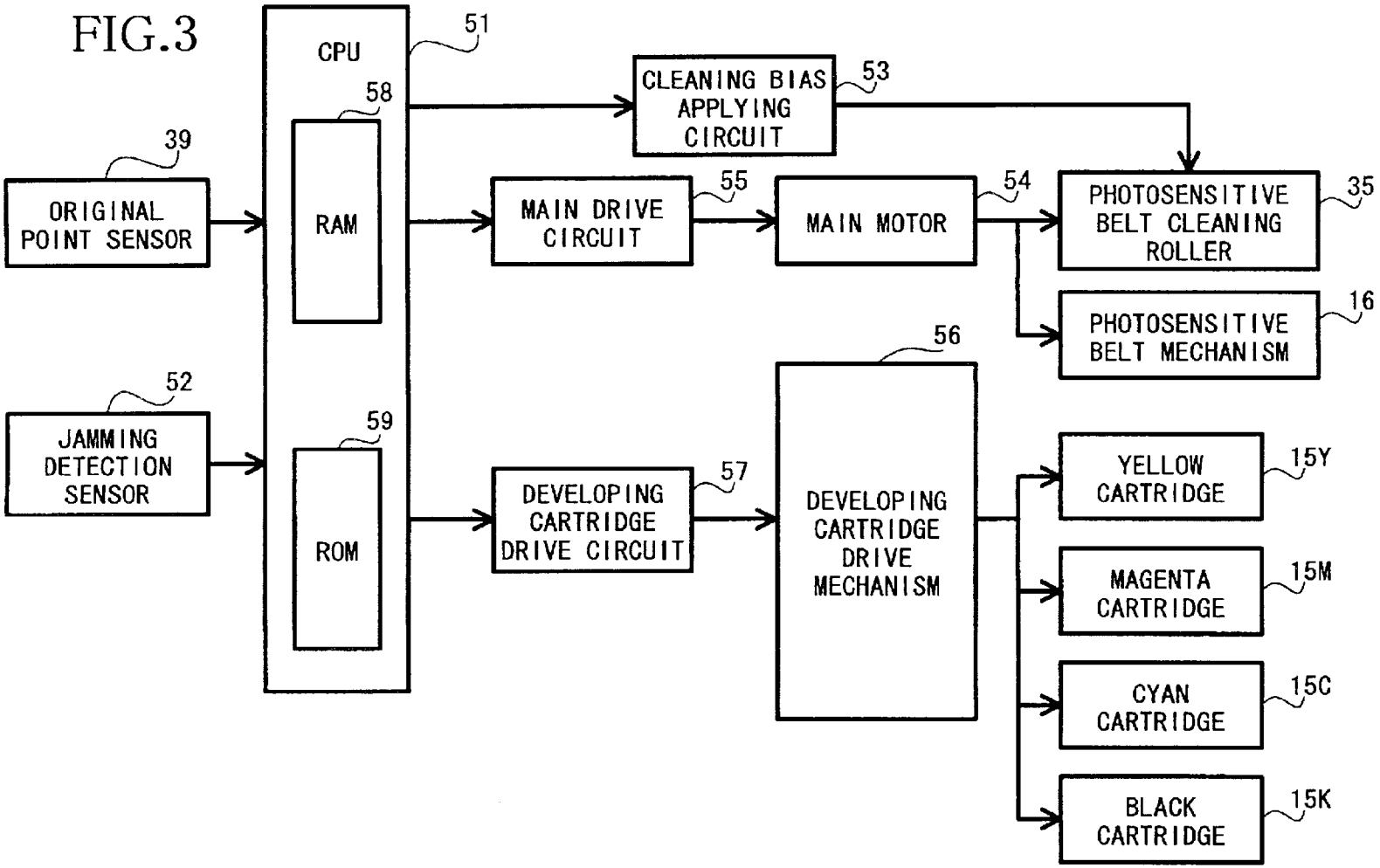
FIG. 3 is a block diagram of a control system for the color laser printer shown in FIG. 1.

As shown in FIG. 3, a CPU 51 is connected to the original point sensor 39, a jamming detection sensor 52, a cleaning bias applying circuit 53, a main drive circuit 55 for controlling drive of the main motor 54 and a developing cartridge drive circuit 47 for controlling drive of the developing cartridge drive mechanism 56.

The CPU 51 has a RAM 58 and a ROM 59 and executes control of each portion. A numeric value sent from the original point sensor 39 and the jamming detection sensor 52 is temporarily stored in the RAM 58. Various control programs, such as a main drive control program, a stop control program and a deterioration stop control program for controlling the cleaning bias applying circuit 53, the main drive circuit 44 and the developing cartridge drive circuit 47, are stored in the ROM 59.

The cleaning bias applying circuit 53 is electrically connected to a roller shaft of the photosensitive belt cleaning roller 35. The cleaning bias applying circuit 53 controls on/off of the cleaning bias that is applied to the photosensitive cleaning roller 35 according to the main drive control program stored in the ROM 59 of the CPU 51.

The main drive circuit 55 is electrically connected to the main motor 54. The main motor 54 is connected to the photosensitive cleaning roller 35 and the second photosensitive belt roller 20 via a gear train (not shown). Other drive members, such as the transporting roller 8, the resist roller 9, the heat roller 17, the transporting roller 29 and the discharge roller 30, are also connected to the main motor 54.

The main drive circuit 55 controls driving or stopping the main motor 54 according to the main drive control program, the stop control program and the deterioration stop control program that are stored in the ROM 59 of the CPU 51. The photosensitive cleaning roller 35 and the second photosensitive belt roller 20 are controlled to be driven or stopped according to the main drive control program, the stop control program and the deterioration stop control program.

The developing cartridge drive circuit 57 is electrically connected to the developing cartridge drive mechanism 56. The yellow developing cartridge 15Y, the magenta developing cartridge 15M, the cyan developing cartridge 15C and the black developing cartridge 15K are connected to the developing cartridge drive mechanism 56. The developing cartridge drive mechanism 56 has a motor and a clutch mechanism and moves each cartridge 15Y, 15M, 15C, 15K separately forward and rearward in the horizontal direction.

The drive of the developing cartridge drive mechanism 56 is controlled by the main drive control program stored in the ROM 59 of the CPU 51 via the developing cartridge drive circuit 57. Therefore, each of the yellow developing cartridge 15Y, the magenta developing cartridge 15M, the cyan developing cartridge 15C and the black developing cartridge 15K is controlled to contact or separate from the photosensitive belt 22 according to the main drive control program.

The color laser printer 1 of this embodiment is controlled according to the stop control program so that the photosensitive belt 22 stops in a position so that the stop position 44 of the no-image region 41 set on the photosensitive belt 22 is in contact with the photosensitive belt cleaning roller 35.

Next, control according to the stop control program and an image forming operation according to control of the main drive control program will be explained referring to FIG. 4. When a power source of the color laser printer 1 is turned on, as a previous operation to the image forming operation, the main motor 54 is driven to rotate the second photosensitive belt roller 20. Then, the photosensitive belt 22 is moved and the opening portion 42 is detected by the original point sensor 39. When a predetermined time has passed after detection of the original point (opening portion 42), the main motor 54 is stopped and the movement of the photosensitive belt 22 is stopped.

At this time, the stop position 44 of the no-image region 41 of the photosensitive belt 22 faces the photosensitive belt cleaning roller 35. The above predetermined time is time required so that the photosensitive belt 22 moves to reach the position where the stop position 44 faces the photosensitive belt cleaning roller 35 and the predetermined time is previously determined based on the rotation speed of the second photosensitive belt roller 20.

Figure 4A:
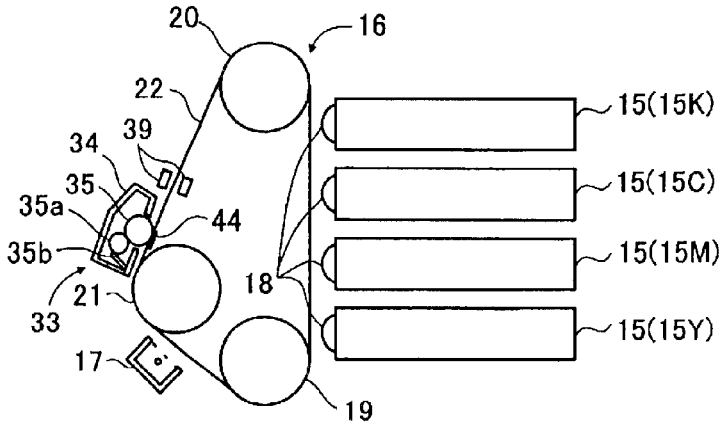
FIGS. 4A–4C are cross-sectional views of a photosensitive belt mechanism of the color laser printer shown in FIG. 1 and a main portion of a developing cartridge, FIG. 4A showing a condition where the photosensitive belt is in a standard position, FIG. 4B showing a condition where a contact position of the photosensitive belt contacts the developing cartridge, and FIG. 4C showing a condition that a separating position of the photosensitive belt separates from the developing cartridge.

Before the image forming operation, as shown in FIG. 4A, the photosensitive belt 22 is necessarily positioned at the position where the stop position 44 faces the photosensitive belt cleaning roller 35 (hereinafter, the standard position).

The image forming operation is started according to the main control program. The main motor 54 is driven and the photosensitive belt 22 starts to move. At the same time as the main motor 54 is started to be driven, the first timer starts to count. When the count value reaches a time required so that the photosensitive belt 22 moves from the standard position to a position where the laser beam is irradiated to the photosensitive belt 22 (hereinafter, an exposure position), the laser beam is irradiated from the scanner unit to expose the surface of the photosensitive belt 22. Then, a static latent image is formed on the image region of the photosensitive belt 22.

Next, at the same time as the laser beam is started to be irradiated, a second timer starts to count. When the count value reaches a time required so that the photosensitive belt 22 moves from the exposure position to a position where the developing roller 18 of the developing cartridge 15 corresponding to a color that is to be developed faces the contact position 45, the developing cartridge drive mechanism 56 is driven and the developing cartridge 15 corresponding to a color that is to be developed is moved in a horizontal front direction. Then, the developing roller 18 of the developing cartridge 15 contacts the surface of the photosensitive belt 22 and toner is supplied to the static latent image that is formed on the photosensitive belt 22. The above count value is different for each color of the developing cartridge 15.

Figure 4B:
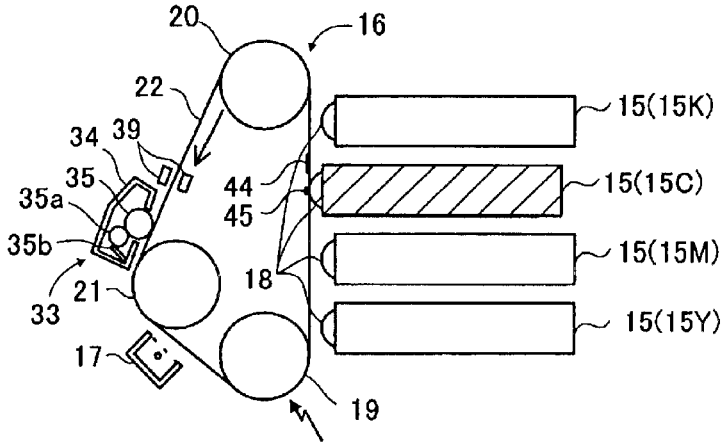

In the example of FIG. 4, in FIG. 4B, the cyan cartridge 15C is moved in a horizontal forward (front) direction by the developing cartridge drive mechanism 56 and the developing roller 18 contacts the contact position 45 of the photosensitive belt 22.

At the same time, as the developing cartridge drive mechanism 56 is driven, a third timer starts to count. When the count value reaches a time required that the photosensitive belt 22 moves and the developing roller 18 that presently contacts the photosensitive belt 22 faces the separating position 43 of the photosensitive belt 22, that is, when the whole image region 40 of the photosensitive belt 22 contacts the developing roller 18, the developing cartridge drive mechanism 56 is driven and the developing cartridge 15 corresponding to a color that is developed is moved in a horizontal rearward direction. Then, the developing roller 18 of the developing cartridge 15 is separated from the surface of the photosensitive belt 22 and a developing operation for forming a visible image by toner of a color stored in the developing cartridge 15 is ended.

Figure 4C:
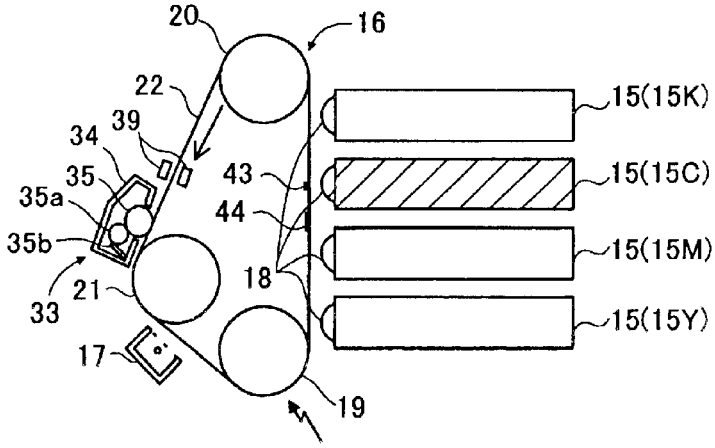

In FIG. 4C, the cyan cartridge 15C moves in the horizontal rearward direction at the separating position 43 of the photosensitive belt 22 by driving the developing cartridge drive mechanism 56 and the developing roller 18 is separated from the surface of the photosensitive belt 22.

When a developing operation by one developing cartridge 15 is ended, the photosensitive belt 22 moves and the opening portion 42 is detected again by the original point sensor 39. The same operation as the above developing operation is executed for the developing cartridge 15 of the next required color.

The developing operation is repeatedly executed for forming a visible image of each required color. When the developing operation for the up to four colors is ended, toner of the up to four colors is overlapped on the intermediate transfer belt 26.

The color visible image formed by toner of the required colors, up to the four colors, that is transferred onto the intermediate transfer belt 26 is transferred to the paper 3 as described above. When the image forming operation is ended, the stop control program is started.

After the opening portion 42 is detected by the original point sensor 39, driving of the main motor 54 is stopped after a predetermined time required so that the stop position 44 of the photosensitive belt 22 reaches a position facing the photosensitive belt cleaning roller 35. Then, the movement of the photosensitive belt 22 stops and the stop position 44 of the photosensitive belt 22 contacts the cleaning roller 35 as shown in FIG. 4A.

Therefore, in the color laser printer 1 of the embodiment, when the movement of the photosensitive belt 22 stops, the stop position 44 of the photosensitive belt 22 always contacts the cleaning roller 35. In the next image forming operation, an image is formed on the image region 40 of the photosensitive belt 22 and an image is not formed on the stop position 44. There is the possibility that the printer 1 is left for a long time in a condition that the stop position 44 of the photosensitive belt 22 contacts the cleaning roller 35 and the stop position 44 of the photosensitive belt 22 is stained. However, because an image is not formed on the stop position 44, image deterioration is not caused.

A complicated mechanism for preventing a stain on the photosensitive belt 22, such as a contact/separating mechanism for contacting/separating the cleaning roller 35 to/from the photosensitive belt 22, is not required. Image deterioration due to the contact of the cleaning roller 35 and the photosensitive belt 22 is prevented by simple control and a precise image can be always formed.

On the other hand, as described above, when the cleaning roller 35 contacts the stop position 44 of the photosensitive belt 22, the same position of the surface of the cleaning roller 35 does not contact the photosensitive belt 22. Therefore, permanent deformation of the cleaning roller 35 is prevented and a precise cleaning operation can be executed for a long period.

As described above, because the photosensitive belt 22 stops in a condition that the stop position 44 of the photosensitive belt 22 contacts the cleaning roller 35, stains in the stop position 44 will gradually become deep. If the stop position 44 contacts the developing roller 18, toner may be adhered to the stop position even if the stop position 44 is not exposed. In this case, an extra load is generated on the cleaning roller 35 and the toner consumption amount may be increased. Especially, in this embodiment, because toner of different colors is stored in each developing cartridge 15, the load on the cleaning roller 35 or the toner consumption amount may be increased if the stop position 44 contacts the developing roller 18 of each developing cartridge 15.

However, in the color laser printer 1 of the embodiment, the developing roller 18 contacts the contact position 45 of the photosensitive belt 22 and supplies toner to the image region 40 in that condition and the developing roller 18 is separated from the photosensitive belt 22 at the separating position 43 of the photosensitive belt 22. The developing roller 18 does not contact the photosensitive belt 22 immediately before and after the developing roller 18 passes the stop position 44. Therefore, the stop position 44 does not become dirty from toner and the load on the cleaning roller 35 is decreased and an increase in toner consumption amount is prevented.

The color laser printer 1 has the jamming detection sensor 52 (referring to FIG. 3) to detect paper 3 jamming. When jamming is detected, the laser printer 1 is controlled according to the deterioration stop control program. After the opening portion 42 is detected by the original point sensor 39, the main motor 54 is driven until a predetermined time required so that the stop position 44 of the photosensitive belt 22 reaches a position facing the photosensitive belt cleaning roller 35. The photosensitive belt 22 is controlled to stop in a condition that the stop position 44 of the photosensitive belt 22 contacts the cleaning roller 35. That is, after detecting jamming, the photosensitive belt 22 is not stopped right away.

Even when jamming occurs, the photosensitive belt 22 is forcibly moved to a position where the stop position 44 contacts the cleaning roller 35 and stops. Therefore, even when the laser printer 1 is left for a long time in a jamming condition, staining of the image region 40 of the photosensitive belt 22 is prevented. It is also desirable that the photosensitive belt 22 is stopped after the photosensitive belt 22 is forcibly moved when an error other than jamming is caused.

Figure 6:
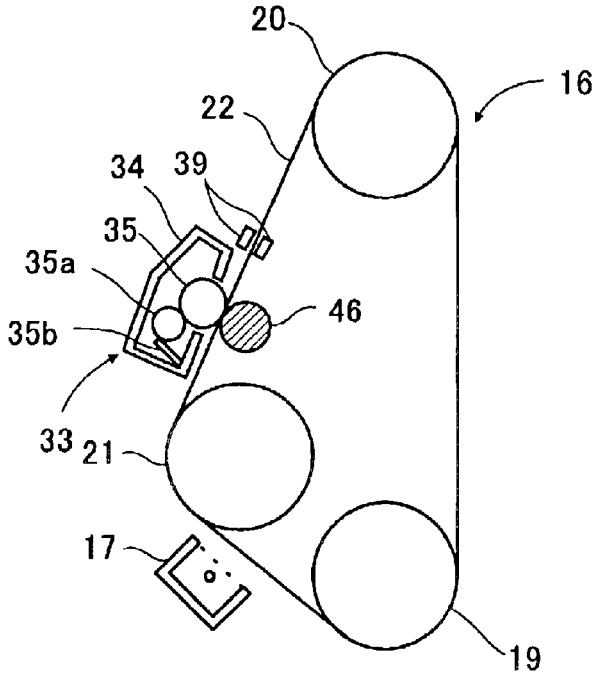
FIG. 6 is an enlarged cross-sectional view of a main portion of a photosensitive belt mechanism of another embodiment.

In the color laser printer shown in FIG. 1, the photosensitive belt cleaning roller 35 is arranged adjacent to the third photosensitive belt roller 21. If the photosensitive cleaning roller 35 cannot be arranged adjacent to either the second photosensitive belt roller 20 or the third photosensitive belt roller 21 because of the structure of the apparatus, the photosensitive cleaning roller 35 may be arranged at a center position between the second photosensitive belt roller 20 and the third photosensitive belt roller 21. A subsidiary pressing roller 46, as a subsidiary pressing member, must be placed at a position corresponding to the photosensitive cleaning roller 35 via the photosensitive belt 22 (FIG. 6).

The subsidiary pressing roller 46 is obtained by covering a metal shaft with a material, such as urethane foam. The material has hardness less than or equal to the hardness of the photosensitive cleaning roller 35. The subsidiary pressing roller 46 presses the photosensitive belt 22 with a weak pressing force. The photosensitive cleaning roller 35 can contact the photosensitive belt 22 precisely and toner can be captured efficiently.

Although the invention has been described in detail with reference to the specific embodiments thereof, it would be apparent to those skilled in the art that various changes, arrangements and modifications may be applied therein without departing from the spirit and scope of the invention.

What is claimed is:

1. An image forming apparatus, comprising:

a photosensitive member having an image region and no-image region and an indicator of a start of the no-image region;

a developing device arranged corresponding to the photosensitive member for supplying developer to the photosensitive member;

a cleaning roller arranged corresponding to the photosensitive member, and in constant contact therewith, for capturing the developer on a surface of the photosensitive member by contacting the surface of the photosensitive member;

a detector that outputs a signal when the indicator is detected; and a controller for stopping the photosensitive member in a condition that the no-image region of the photosensitive member contacts the cleaning roller based on the signal output by the detector.

2. The image forming apparatus according to claim 1, wherein the controller controls the apparatus so that a same position of the cleaning roller does not contact the no-image region of the photosensitive member every time the photosensitive member stops.

3. The image forming apparatus according to claim 2, wherein a length (L) of the photosensitive member, a peripheral length (M) of the cleaning roller and peripheral velocity ratio ($\alpha$) of the cleaning roller with respect to the photosensitive member are set so as to satisfy $L/(\alpha^*M)\neq n$ (n is an integer).

4. The image forming apparatus according to claim 1, wherein the controller stops the photosensitive member in a condition that the no-image region of the photosensitive member contacts the cleaning roller when detecting an operation error of an image forming operation.

5. The image forming apparatus according to claim 1, wherein the developing device is arranged so as to contact/separate from the photosensitive member.

6. The image forming apparatus according to claim 5, wherein the controller controls the apparatus so that the developing device contacts the photosensitive member after a portion contacting the cleaning roller when the photosensitive member stops passes through the developing device and the developing device separates from the photosensitive member before the contact portion reaches the developing device.

7. The image forming apparatus according to claim 6, wherein a plurality of developing devices are provided and developer of a different color is stored in each developing device.

8. The image forming apparatus according to claim 1, wherein the photosensitive member is an endless belt on which a photosensitive layer is formed.

9. The image forming apparatus according to claim 8, further comprising a movement supporting member for moving the photosensitive member, wherein the movement supporting member is arranged so as to contact an inner side surface of the endless belt and the cleaning roller is arranged outside of the endless belt and at a position not corresponding to a contact portion of the endless belt and the movement supporting member.

10. The image forming apparatus according to claim 9, wherein the cleaning roller is arranged adjacent to the movement supporting member.

11. The image forming apparatus according to claim 9, further comprising a subsidiary pressing member arranged so as to oppose the cleaning roller passing the endless belt therebetween, the subsidiary member made of an elastic material.

12. The image forming apparatus according to claim 1, wherein a bias is applied to the cleaning roller for attracting the developer on the photosensitive member.

13. The image forming apparatus according to claim 1, wherein the developer is polymerized toner.

14. The image forming apparatus according to claim 1, further comprising a motor that rotates the photosensitive member, the controller stops the motor when a predetermined time has passed after the detector outputs the detection signal.

15. The image forming apparatus according to claim 1, wherein the controller controls operation of the image forming apparatus, and the image forming apparatus further comprises:

a plurality of rollers;

a motor connected to a drive roller of the plurality of rollers, wherein the photosensitive member is a belt that extends around the plurality of rollers and is moved by the drive roller.

16. The image forming apparatus according to claim 15, wherein the motor rotates the drive roller and the motor is stopped a predetermined time, based on the rotation speed of the drive roller, after the detector outputs the signal the indicator was detected to stop the belt with the cleaning roller in contact with the no-image region.

17. The image forming apparatus according to claim 16, wherein the no-image region includes a stop position area and the cleaning roller contacts the stop position area when the belt is stopped.

18. A cleaning mechanism for a photosensitive member, comprising:

a control element;

a detector opposing the photosensitive member that detects a predetermined position on the photosensitive member;

a cleaning roller opposing the photosensitive member, wherein the photosensitive member has an image area, a no-image area, and a stop area within the no-image area, the control element using the detected predetermined position, stops the photosensitive member and the cleaning roller so they are in contact at the stop area of the photosensitive member and the cleaning roller does not stop at the same position in any two successive rotational stops.

19. The cleaning mechanism, according to claim 18, wherein the photosensitive member is a belt stretched around at least three rollers, the belt having an opening therethrough, and the detector comprises a light transmitter and a light receiver positioned to oppose one another on opposite sides of the belt.

20. The cleaning mechanism according to claim 19, wherein a line tangential to a roller of the at least three rollers intersects the belt at a right angle and a continuation of the line passes through the cleaning roller to a side of the axis of the cleaning roller that is closest to the roller.

21. The cleaning mechanism according to claim 19, further comprising a pressing roller opposing the cleaning roller, the belt passing therebetween.

22. The cleaning mechanism according to claim 18, wherein the cleaning roller has an elastic surface.

23. The cleaning mechanism according to claim 18, further comprising:

a cleaning box rotatably mounting the cleaning roller, the cleaning box having an opening facing the belt;

a secondary cleaning roller rotatably mounted in the cleaning box and contacting the cleaning roller; and a cleaning blade engaging the secondary cleaning roller, the cleaning box collecting toner removed from the belt.

24. The cleaning mechanism according to claim 23, wherein both the cleaning roller and the secondary cleaning roller are electronically biased to attract toner remaining on the belt, the secondary cleaning roller having a greater bias than the cleaning roller.

25. An image forming apparatus, comprising:

a photosensitive member having an image region and no-image region;

a developing device arranged corresponding to the photosensitive member for supplying developer to the photosensitive member;

a cleaning roller arranged corresponding to the photosensitive member, and in constant contact therewith, for capturing the developer on a surface of the photosensitive member by contacting the surface of the photosensitive member; and a controller for stopping the photosensitive member in a condition that the no-image region of the photosensitive member contacts the cleaning roller, wherein the photosensitive member has an indicator of the start of the no-image region; and the image forming apparatus further comprises a detector that outputs a signal to the controller when the start of the no-image region indicator is detected, the controller further controlling the developing device to contact the photosensitive member proximate a downstream edge, in the direction of photosensitive member movement, of the no-image region and to separate from the photosensitive member proximate an upstream edge of the no-image region.

26. The image forming apparatus according to claim 14, wherein the predetermined time is based on movement speed imparted to the photosensitive member by the motor to surely stop with the cleaning roller opposing the no-image region.

* * * * *